US005793243A

United States Patent [19]

Farrow

[11] Patent Number: 5,793,243

[45] Date of Patent: Aug. 11, 1998

[54] METHOD OF STABILIZING AN ELECTRONIC SIGNAL INTEGRATOR

[75] Inventor: John F. Farrow, Plymouth, Mich.

[73] Assignee: Medar, Inc., Farmington Hills, Mich.

[21] Appl. No.: 362,807

[22] Filed: Dec. 22, 1994

[51] Int. Cl.[6] ..... G06G 7/186

[52] U.S. Cl. ..... 327/345; 327/341; 327/307; 327/552; 327/95; 330/9

[58] Field of Search ..... 327/336, 344, 327/137, 167, 560, 561, 563, 95, 94, 91, 307, 341, 345, 552, 558, 559, 562, 339; 330/9, 85

[56] References Cited

U.S. PATENT DOCUMENTS

| | | | |
|---|---|---|---|
| 4,082,998 | 4/1978 | Marriott | 327/530 |
| 4,091,297 | 5/1978 | Stephens | 327/58 |
| 4,163,947 | 8/1979 | Weedon | 327/341 |
| 4,323,852 | 4/1982 | Walker | 330/9 |
| 4,560,958 | 12/1985 | Hofer | 331/109 |
| 4,760,345 | 7/1988 | Büsser et al. | 327/341 |

FOREIGN PATENT DOCUMENTS

| | | | |
|---|---|---|---|
| 54-4043 | 1/1979 | Japan | 327/336 |
| 6087508 | 5/1985 | Japan | 330/9 |
| 63-275218 | 11/1988 | Japan | 327/137 |

*Primary Examiner*—Timothy P. Callahan
*Assistant Examiner*—Terry L. Englund

[57] ABSTRACT

A signal integrator stabilization circuit comprises an operational amplifier functioning as a comparator. The circuit further comprises an attenuator in the amplifier's feedback, thereby generating a feedback signal which is sampled to produce a sampling signal. The integrator is driven with a preselected ratio of the feedback signal and the sampling signal to produce a stabilized output signal approaching a zero value which has a good DC stability without compromising the ability to accurately integrate high frequency signals.

10 Claims, 3 Drawing Sheets

METHOD OF STABILIZING AN ELECTRONIC SIGNAL INTEGRATOR

BACKGROUND OF THE INVENTION

1. Field of the Invention

The present invention relates to electronic circuitry and more particularly to the circuitry commonly used to integrate electronic signals.

2. Description of the Prior Art

Many electronic signals must be integrated to be useful. For example, an air-wound current measurement transformer produces a signal that corresponds to the first derivative of the current actually measured. In order to study the signal waveshape and accurately measure the amplitude of the current, the transformer current signal must be integrated.

Typically, electronic signal integrators include several drawbacks. First, basic integrator circuitry typically includes an operational amplifier with a capacitor in the feedback loop from the output to the inverting input of the operational amplifier. Such an integrator is inherently unstable because it lacks any DC feedback from the output to the inverting input of the operational amplifier. Without DC feedback, any DC offset within the amplifier will be integrated. The integrated DC offset causes the output voltage of the amplifier to steadily change until the saturation voltage of the amplifier output stage is reached. In this saturated state, the circuit is useless as an integrator.

Second, operational amplifiers generate electronic noise. The noise within an operational amplifier is a function of the input signal frequency. The amount of noise generated increases as the frequency approaches zero. Such noise is typically referred to as 1/F noise where F stands for the frequency. 1/F noise is particularly bothersome in the typical integrator circuitry described above. 1/F noise causes the integrator circuitry gain to approach the open loop gain of the operational amplifier as the frequency approaches zero. Therefore, the output signal generated primarily by the 1/F noise approaches the maximum output of the operational amplifier, resulting in significant error.

1/F noise causes further problems making it virtually impossible to manually adjust the offset voltage of the amplifier in the integrator circuitry to eliminate output voltage drift. The 1/F noise causes the direction and speed of the voltage drift to be unstable. Therefore, it is impossible to find a correct setting to adjust the offset voltage of the amplifier.

SUMMARY OF THE INVENTION

The present invention includes a method of stabilizing basic integrator circuitry by providing an operational amplifier as a comparator within the feedback loop of the integrator operational amplifier. The output signal from the comparator operational amplifier is attenuated before being fed back into the integrator circuitry. When the output of the integrator operational amplifier has a non-zero value, the stabilizing amplifier will seek to drive the output of the integrator amplifier back down to a zero value. In this manner, the output of the integrator operational amplifier approaches zero and, therefore, the integrator circuitry is stabilized.

The method of the present invention allows a high-accuracy integrator to be built to overcome the above-discussed problems. Building a high accuracy integrator includes the realization that many signals requiring integration have no DC component. Returning to the example of the air wound current pick up coil, where that coil is used to measure a transformer AC current, neither the original current nor the output of the pickup coil contains any DC component. Therefore, such a signal can be accurately integrated using an integrator lacking the ability to integrate DC signals or signals close to DC in frequency. Basic integrator circuitry can be made DC-stable because there is no need to accurately integrate signals of extremely low frequency and DC signals.

These and other features and objects of the present invention can best be understood from the following specification and drawings, of which the following is a brief description.

DETAILED DESCRIPTION OF THE PREFERRED EMBODIMENTS

Figure 1:
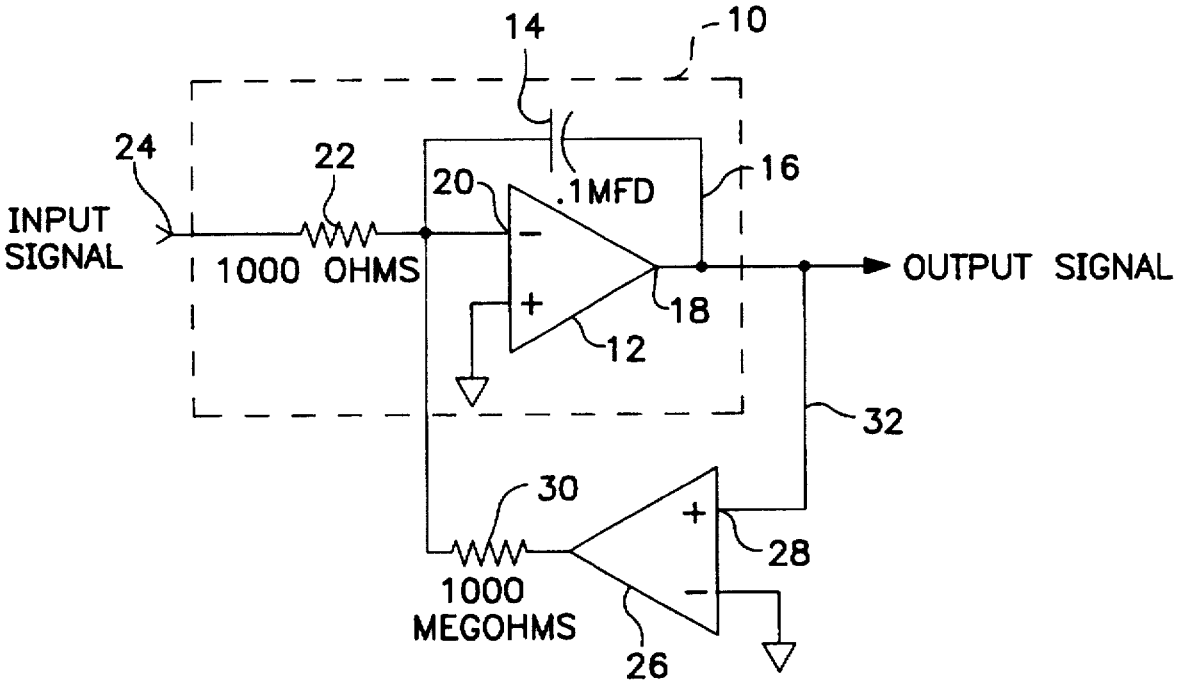
FIG. 1 is a schematic diagrammatic representation of basic integrator circuitry coupled with the inventive stabilization circuitry.

FIG. 1 illustrates the basic integrator circuitry within the broken-line box 10. The basic integrator circuitry includes an integrating amplifier 12 with a capacitor 14 within feedback loop 16 running from the integrating amplifier output 18 to the inverting input terminal 20. The basic integrator circuitry also includes a resistor 22 between the lead 24 for the input signal to be integrated and the inverting input terminal 20 on integrating amplifier 12. Stabilization amplifier 26 is connected to the basic integrator circuitry according to the method of the present invention. The output 18 of integrating amplifier 12 is coupled to the non-inverting input terminal 28 of stabilization amplifier 26. The output signal from stabilization amplifier 26 is fed through an attenuator 30, shown as a resistor, to the inverting input terminal 20 of integrating amplifier 12. In one embodiment, integrating amplifier 12 and stabilization amplifier 26 are chopper-stabilized FET input operational amplifiers with a maximum input offset voltage of 5 microvolts. One embodiment includes Texas Instruments Part No. TLC 2652 as integrating amplifier 12 and stabilization amplifier 26. The illustrated embodiment includes the assumption that amplifiers 12 and 26 are operating from a ±7.5 volt power supply and have a maximum output of ±5 volts.

Input resistor 22 and capacitor 14 values can be chosen according to requirements for a desired output signal level given a preselected input signal level. In general, lower values of input resistor 22 and capacitor 14 increase the output signal level. The illustrated embodiment includes a value for the input resistor of 1,000 ohms and a value for the capacitor of 0.1 microfarads. Attenuating resistor 30 preferably has a value in a specific ratio to input resistor 22 such that the full scale output of stabilization amplifier 26 is attenuated to a value just large enough to cancel the input offset voltage and current of integrating amplifier 12.

The circuitry illustrated in FIG. 1 works basically as follows. Assuming zero signal input and zero initial charge on capacitor 14, stabilization amplifier 26 will saturate to either its maximum positive or negative output voltage whenever the output voltage of integrating amplifier 12 is anything other than zero. The output signal from stabilization amplifier 26 is fed back through attenuator 30 to drive the output of integrating amplifier 12 back toward a zero value. The integrating circuit formed by integrating amplifier 12 and capacitor 14 imposes a 90 degree phase shift into the signal path. Therefore, the entire circuitry of FIG. 1 is AC-wise unstable; it oscillates. The frequency of such oscillation depends on the component values selected for attenuator 30 and capacitor 14 and the open-loop gain versus frequency characteristics of operational amplifiers 12 and 26. The circuit will oscillate at the highest frequency corresponding to a loop gain slightly above unity. The loop gain is the gain of the circuit from the inverting input 20 of integrating amplifier 12 through integrating amplifier 12, through stabilization amplifier 26 and attenuator 30, back to the inverting input 20 of integrating amplifier 12. In the illustrated embodiment, the frequency of oscillation would be approximately 50 Hz.

The amplitude of the oscillation at the output of integrating amplifier 12 is rather low. In the illustrated embodiment, the amplitude would be slightly under ½ millivolt. The oscillation amplitude has a low value because the output signal of stabilization amplifier 26 (oscillating at a maximum value) is highly attenuated through attenuator 30. Assuming a desired signal output of 5 volts peak in the illustrated embodiment, the error introduced by the ½ millivolt oscillation is 0.01 percent.

The feedback loop 32 through stabilization amplifier 26 and attenuator 30 renders the illustrated circuit unsuitable for integrating signals containing a DC component. When an input signal to the integrator 10 causes the output signal from the integrator 10 to be nonzero, the output of stabilization amplifier 26 attempts to "cancel out" the input offset voltage signal such that the output signal from the integrator 10 responsively approaches a zero value. The error generated by the output of stabilization amplifier 26 is a function of the desired signal frequency. Assume that stabilization amplifier 26 is at a full saturation voltage; approximately 5 volts. This saturation causes the output signal from integrating amplifier 12 to change at the rate of 0.05 volts per second because the time constant from the integrating circuit represented by attenuator 30 and capacitor 14 is 100 seconds. Assuming an input signal frequency of 60 Hz, the error per half-cycle at this frequency is approximately ½ millivolt. With a maximum signal output level of 5 volts, the ½ millivolt error corresponds to an error of 0.01 percent.

The circuitry illustrated in FIG. 1 has an additional advantageous feature in that it cancels most of the effects of 1/F noise. 1/F noise is electronic noise generated within integrating amplifier 12 that increases as the signal frequency approaches zero. 1/F noise behaves like a shift in the input offset voltage of integrating amplifier 12. The components in feedback loop 32 respond to cancel the shift in the input offset voltage. However, because the output signal of stabilization amplifier 26 is attenuated by input resistor 22 and attenuator 30, a limited amount of 1/F noise can be cancelled. In the illustrated embodiment, the total amplitude available to cancel input offset voltage and 1/F noise is approximately 5 microvolts. The total effects of worst-case input offset voltage in current and average 1/F noise is typically less than 5 microvolts in the illustrated embodiment. However, the statistical nature of 1/F noise makes it possible that there will be short intervals when the signal required to cancel the 1/F noise is greater than 5 microvolts. The amount that the stabilization signal is attenuated can be adjusted according to optimal circuit behavior criteria. For example, it may be advantageous, from an error standpoint, to allow occasional 1/F noise bursts to pass through the circuitry or alternatively to reduce the value of attenuator 30 in order to completely cancel the 1/F noise bursts. Reducing the value of attenuator 30 correspondingly increases error from other sources. The exact criteria and values selected will depend, in part, upon the statistical distribution of 1/F peak amplitude over time.

Another type of error occurs in the circuitry illustrated in FIG. 1 when a steady-state signal is applied to the circuit. The output signal from stabilization amplifier 26 is affected by the output signal from integrating amplifier 12. When the output voltage of integrating amplifier 12 is essentially zero, the average voltage at the output of stabilization amplifier 26 is just large enough to cancel the effective input offset voltage of integrating amplifier 12. However, since the circuit is inherently unstable, it oscillates about zero and the voltage output of stabilization amplifier 26 is not a steady DC voltage, but rather is an oscillating waveform. These conditions exist when the circuit is at equilibrium. The average DC value of the oscillating waveform output signal from stabilization amplifier 26 equals whatever voltage is required to null the effective input offset voltage of integrating amplifier 12. However, when an input signal is applied to the circuit, the output of stabilization amplifier 26 will change to essentially a square wave. Typically, the output signal from integrating amplifier 12 is symmetrical about zero. Correspondingly, the output signal from stabilization amplifier 26 will be a square wave, also symmetrical about zero. A square wave symmetrical about zero has an average DC value of zero. Therefore, the output of stabilization amplifier 26 no longer has the proper average voltage needed to cancel the input offset voltage of the integrating amplifier 12. Under these conditions, the output from integrating amplifier 12 undergoes a DC level shift until the duty cycle of the square wave output from stabilization amplifier 26 equals the average DC value required to cancel the effective input offset voltage of integrating amplifier 12.

A similar analysis applies to an input signal waveform that is not symmetrical about zero. A non-symmetrical input signal typically results in output waveform from the integrator 10 that is not symmetrical. Therefore, the average voltage output from stabilization amplifier 26 will not cancel the effective input offset voltage of the integrating amplifier 12. Therefore, the average DC value of the signal at the output 18 of integrating amplifier 12 will shift until the square wave output from stabilization amplifier 26 becomes non-symmetrical enough to have a sufficiently large average DC value to cancel the effective input offset voltage of integrating amplifier 12.

There are several ways to handle the DC level shift in the output signal of the integrator 10. When the frequency range of the integrated signal is known (for example, a waveform representing a current on an AC power line of fixed frequency) a relatively simple high-pass filter can be used to accommodate the DC level shift.

Figure 2:
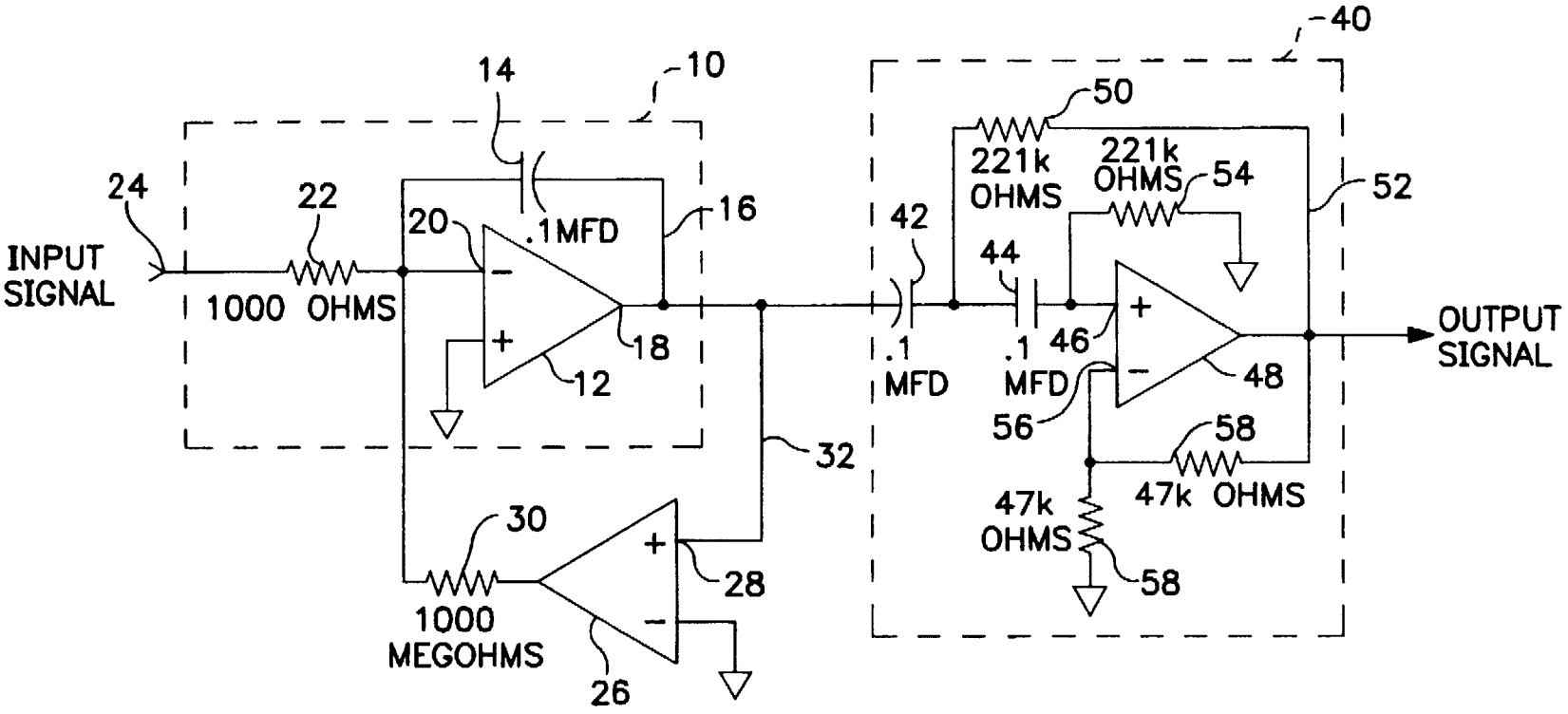
FIG. 2 is a diagrammatic schematic representation of the inventive stabilization circuitry including a two pole high-pass filter coupled with the output of the integrator circuitry.

FIG. 2 shows the inventive stabilization circuitry from FIG. 1 coupled with a two-pole high-pass filter 40. High-pass filter 40 is made up of capacitor 42 and capacitor 44 coupled between the output of the integrator circuitry 10 and the non-inverting input 46 of filtering amplifier 48. In one embodiment, capacitors 42 and 44 have a 0.1 microfarad capacitance, respectively. Also connected to the non-inverting input 46 of filtering amplifier 48 is a feedback resistor 50 connected in feedback loop 52 running from the output of filtering amplifier 48 to the non-inverting input terminal 46 of filtering amplifier 48, specifically connected between capacitor 42 and capacitor 44. The input line to non-inverting input terminal 46 also contains resistor 54 between capacitor 44 and non-inverting input terminal 46. In one embodiment, resistors 50 and 54 have resistance values equal to 221 kiloohms, respectively. The inverting input terminal 56 is connected to the output of the filtering amplifier 48 through a pair of resistors 58. In one embodiment, resistors 58 have a resistance value equal to 47 kiloohms, respectively. The illustrated high-pass filter has a cut off frequency of 0.5 Hz and a damping factor of 1.

The DC shift of the integrator circuitry cannot contain any frequencies significantly above 0.01 Hz because the time constant of the integrator stabilization loop 32 is approximately 100 seconds. Any such DC shift frequencies are attenuated by a factor of approximately 5000:1 by the 0.5 Hz high-pass filter 40. Accordingly, signals having a frequency of at least 60 Hz are attenuated by less than 0.5 percent and a phase shift of less than 1 degree is introduced by high-pass filter 40. The filter parameters such as the damping factor, cutoff frequency, or number of poles can be adjusted to further reduce the attenuation and phase shift error. The high-pass filter method of eliminating the DC offset shift, including a filter such as that illustrated in FIG. 2, works well when the operating frequency is known and stable. However, a different method is necessary when the frequency is unknown or where extreme accuracy is required.

Figure 3:
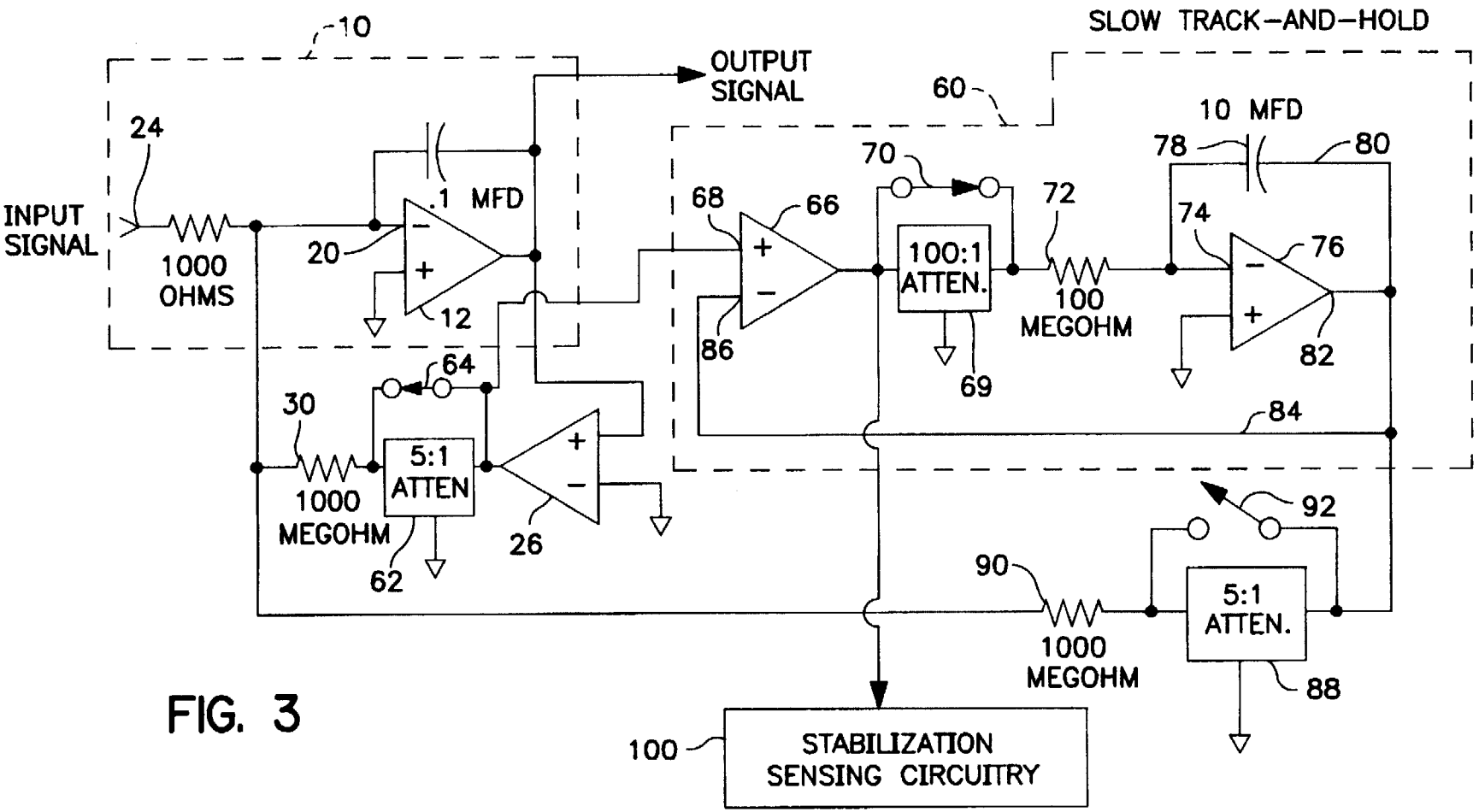
FIG. 3 is a diagrammatic schematic representation of the inventive stabilization circuitry coupled with slow track-and-hold circuitry.

FIG. 3 illustrates one embodiment for implementing another method to compensate for DC level shift according to the present invention.

Integrator circuitry 10 is coupled with stabilization amplifier 26. The output from stabilization amplifier 26 is coupled to the slow track and hold circuitry within broken-lined box 60. Attenuating means 62 is inserted between the output of stabilization amplifier 26 and attenuator 30. Attenuating means 62 can be any attenuator commonly used by those skilled in the art and, therefore, will not be described further. Attenuating means 62 is connected in parallel with switch 64. The function of switch 64 shall be described below.

Slow track and hold circuitry 60 includes comparator amplifier 66 coupled, at the non-inverting input terminal 68, to the output of stabilization amplifier 26. The output of comparator amplifier 66 is coupled to attenuating means 69, which is connected in parallel to switch 70. A resistor 72 is provided between attenuating means 69 and the inverting input terminal 74 of output amplifier 76. Output amplifier 76 has a capacitor 78 in the feedback loop 80 running from the output terminal 82 to inverting input terminal 74. The output signal from output amplifier 76 is coupled, through feedback loop 84 to the inverting input terminal 86 of comparator amplifier 66.

The output of comparator amplifier 66 is coupled to conventional stabilization sensing circuitry schematically illustrated as box 100. The output of operational amplifier 76 is coupled to the inverting input terminal 20 of integrating amplifier 12 through attenuating means 88 and resistor 90. Attenuating means 88 is connected in parallel with switch 92.

In one embodiment attenuating means 69 attenuates electronic signals at a 100:1 ratio, resistor 72 has a resistance of 100 megaohms, capacitor 78 has a capacitance of 10 microfarads, attenuating means 88 attenuates electronic signals at a 5:1 ratio, resistor 90 has a resistance of 1000 megaohms and attenuating means 62 attenuates signals at a 5:1 ratio.

For illustration, the function of the track-and-hold circuit 60 will be explained using the values described in the previous paragraph.

In FIG. 3, the slow track-and-hold circuit 60 is used to extract the equivalent DC voltage of stabilization amplifier 26. The time constant of the slow track-and-hold circuit is on approximately several minutes. The output voltage of the slow track-and-hold circuit will eventually equal the average DC voltage of an oscillating track-and-hold input signal. Under these conditions, the output voltage from comparator amplifier 66 changes relatively dramatically. The output voltage from comparator amplifier 66 will change from primarily being saturated toward one polarity, to a rapid oscillation between positive and negative saturation. This change in the character of the comparator amplifier output signal is used to determine when the track-and-hold circuit has acquired the correct voltage.

While the track-and-hold circuit is acquiring its signal, the integrator 10 is held in stabilization by the output of stabilization amplifier 26 as explained in the description of FIG. 1. A slight improvement in circuit performance is obtainable by using the output of stabilization amplifier 26 and track-and-hold output amplifier 76 to stabilize the integrator 10. In one embodiment, a 5:1 ratio between the stabilization circuit and the track-and-hold circuit works well to minimize stabilization time by causing low frequency oscillations to decay more rapidly. A different ratio may be appropriate, for example, when the circuit configuration is varied from that of FIG. 3.

Track-and-hold circuitry 60 will stabilize internally. Once stabilization sensing circuitry 100 appropriately indicates that track-and-hold circuitry 60 is stabilized, the entire circuit of FIG. 3 can be switched from stabilization to integration mode. In stabilization mode, switch 64 and switch 70 are closed while switch 92 is opened (as illustrated). Switches 64 and 70 are opened and switch 92 is closed to switch the circuit into integration mode. Opening switch 64 causes the output signal from stabilization amplifier 26 to be attenuated by a factor of 5. Conversely, closing switch 92 effectively bypasses attenuating means 88. The speed of comparator amplifier 66 is greatly reduced when switch 70 is opened. In the illustrated embodiment with the above-defined component values, the track-and-hold circuitry speed is reduced by a factor of 100. Component value changes will affect the circuit performance and may be varied according to particular needs.

An important feature inherent in the inventive method of stabilizing an electronic signal integrator 10 is that the integration circuitry and the stabilization circuitry essentially are separable. Therefore, integrating amplifier 12 need not be the same type as those used for stabilization. For example, the integrator circuit 10 can be designed to use an amplifier 12 having a very high gain at very high frequencies so that high frequency signals can be integrated. Such amplifiers typically have relatively high input bias currents, high input offset voltages and typically induce large amounts of 1/F noise. These features usually make such amplifiers unsuitable for integrating. However, most of these shortcomings can be overcome with the use of the stabilization circuitry associated with the method of the present invention. The values and configuration of the stabilization circuitry can be chosen to optimally overcome the shortcomings of whatever amplifier is used as the integrator. Accordingly, the inventive method of stabilizing an integrator allows the integrator to have excellent DC stability without compromising the ability to accurately integrate high frequency signals.

It will be apparent to a skilled artisan that the preceding disclosure is exemplary rather than limiting in nature. The preferred embodiments were discussed to enable a skilled artisan to practice the inventive method of stabilizing an electronic signal integrator. Modifications and variations are possible without departing from the purview and spirit of the present invention which are limited only by the appended claims.

I claim:

1. A method for stabilizing the output signal of an electronic signal integrator, comprising the steps of:

(a) detecting when the integrator output signal has a non-zero value;

(b) comparing the integrator output signal to a preselected reference signal and producing a comparator signal;

(c) attenuating the comparator signal to thereby produce a feedback signal; and (d) driving the integrator, using the feedback signal, to thereby produce the stabilized integrator output signal that approaches a zero value, said driving being performed by (1) extracting an average zero DC value from the feedback signal, using means for sampling the feedback signal and for producing a sampling output signal, and (2) providing switching means for altering values of the feedback signal and the sampling output signal relative to each other.

2. The method of claim 1 further comprising the step of filtering the stabilized integrator output signal to thereby eliminate a shift in an average output voltage of the integrator output signal.

3. A method for stabilizing the output signal of an electronic signal integrator, comprising the steps of:

(a) detecting when the integrator output signal has a non-zero value;

(b) comparing the integrator output signal to a preselected reference signal and producing a comparator signal, said comparator signal having a 90 degree phase shift relative to the integrator output signal;

(c) attenuating the comparator signal to thereby produce a feedback signal;

(d) sampling the feedback signal to produce a sampling output signal; and, (e) altering the values of the feedback signal and the sampling output signal relative to each other, to thereby produce the stabilized integrator output signal that oscillates about zero.

4. The method of claim 3 further comprising the step of filtering the stabilized integrator output signal to thereby eliminate a shift in an average output voltage of said integrator output signal.

5. A method for eliminating noise in the output signal of an electronic signal integrator, comprising the steps of:

(a) detecting when the integrator output signal has a non-zero value;

(b) comparing the integrator output signal to a preselected reference signal and producing a comparator signal;

(c) attenuating the comparator signal to thereby produce a feedback signal; and (d) driving the integrator, using the feedback signal, to thereby produce the integrator output signal that approaches a zero value, said feedback signal cancelling out shift in an input offset voltage of the integrator caused by said noise, said driving being performed by (1) extracting an average DC value from the feedback signal and producing a sampling output signal, and (2) providing switching means for altering values of the feedback signal and the sampling output signal relative to each other.

6. The method of claim 5 further comprising the step of filtering the stabilized integrator output signal to thereby eliminate a shift in an average output voltage of said integrator output signal.

7. Apparatus for stabilizing an output signal of an integrator, wherein the apparatus comprises:

means for comparing said output signal to a preselected reference voltage, said comparing means having an input coupled to an output of the integrator for receiving the output signal and an output for producing a driving signal;

first attenuating means coupled to said output of said comparing means, said first attenuating means being coupled to an input of said integrator whereby said driving signal is attenuated and fed into said integrator;

sampling means coupled to the output of said comparing means for sampling the driving signal of said comparing means and for producing a sampling output signal; and, switching means for driving said integrator with one of two preselected ratios of said driving signal and said sampling output signal, said sampling signal means including (1) a first operational amplifier with inverting and non-inverting input terminals, wherein the non-inverting input terminal is coupled to said comparing means output, (2) second attenuating means coupled to an output of said first amplifier, (3) a resistor coupled to said second attenuating means, and (4) a second amplifier with an inverting input coupled to said resistor and a non-inverting input coupled to the preselected reference voltage, said second amplifier having an output coupled to said inverting input of said first amplifier.

8. The apparatus of claim 7 wherein said comparing means comprises an operational amplifier having a noninverting input terminal coupled to said output of said integrator and an inverting input terminal coupled to said preselected reference voltage, said amplifier having an output coupled to the input of said integrator through said first attenuating means.

9. The apparatus of claim 7 further comprising means for filtering the output of said integrator.

10. The apparatus of claim 9 wherein said means for filtering comprises a two-pole high-pass filter.

* * * * *